US006217113B1

(12) United States Patent
Knatz

(10) Patent No.: US 6,217,113 B1
(45) Date of Patent: Apr. 17, 2001

(54) CARRY-ALL BACKPACK

(76) Inventor: Kenneth Knatz, 1300 Aldrich La., Laurel, NY (US) 11948

( * ) Notice: Subject to any disclaimer, the term of this patent is extended or adjusted under 35 U.S.C. 154(b) by 0 days.

(21) Appl. No.: 09/444,895

(22) Filed: Nov. 22, 1999

(51) Int. Cl.[7] ..... A47C 13/00
(52) U.S. Cl. ..... 297/118; 297/129; 224/155
(58) Field of Search ..... 297/118, 129, 297/188.06; 224/153, 155, 156, 212

(56) References Cited

U.S. PATENT DOCUMENTS

| | | | | |
|---|---|---|---|---|
| D. 410,333 | | 6/1999 | Coca . | |
| 5,016,792 | * | 5/1991 | Jay | 297/129 X |
| 5,303,975 | | 4/1994 | Asato . | |
| 5,409,291 | * | 4/1995 | Lamb et al. | 297/129 |
| 5,492,255 | | 2/1996 | Gansky et al. . | |
| 5,588,570 | | 12/1996 | Zirbel . | |
| 5,628,437 | * | 5/1997 | Kober | 297/129 X |
| 5,927,798 | * | 7/1999 | Ahn | 297/129 |
| 5,957,349 | * | 9/1999 | Krulik | 297/129 X |
| 5,988,465 | * | 11/1999 | Vitale et al. | 297/129 X |

* cited by examiner

*Primary Examiner*—Peter M. Cuomo
*Assistant Examiner*—Stephen Vu
(74) *Attorney, Agent, or Firm*—Michael I. Kroll

(57) ABSTRACT

A multipurpose backpack 22 having a seat member 50. The device discloses a pair of upright standing frame members 20 having a cross member 26 further having a larger 22 and smaller 24 storage member disposed thereon. A pair of backstraps 14 are used to secure the backpack to a user 12. The frame members 20 are hollow and house an inner, extendable member 42 having a tapered end 36 for being positioned in soil. Pins 34 are used to lock the inner legs 42 into position. A pair of rotatable secondary legs 36 are provided which when rotated comprise a seat member 50 upon which the user 12 can sit.

10 Claims, 8 Drawing Sheets

CARRY-ALL BACKPACK

BACKGROUND OF THE INVENTION

1. Field of the Invention

The present invention relates generally to backpacks and, more specifically, to a backpack-like device comprising a frame member and a storage member. The frame member is constructed of a pair of primary leg members connected by a cross member having the storage member disposed therebetween. The storage member can be compartmentalized. Each compartment having means for access comprising zippers and/or buckled flaps. Each primary leg member has an adjustable strap attached thereto providing means for carrying said backpack-like device. Also providing means for fixedly attaching said device to a boat console. The primary leg members are hollow tubes providing means for using said leg members as fishing rod holders or converting said leg members, through the use of additional attachments, into a rack for holding such items as a quiver of arrows or rifle. Each primary leg member has an extendable and retractable portion contained therein allowing height adjustment, as well as the capability of leveling said device on uneven ground and having a pin for fixing said extendable portion to the selected position and said primary leg members having a tapered spike-like end providing means for easily inserting said device into sandy soil, as well as providing anchoring means for said backpack-like device. Further, said primary leg members having an exterior pivotal secondary leg member being of substantially the same size as the primary leg members. The secondary leg members have a fabric-like material attached therebetween and said fabric-like material being additionally attached to the frame cross member. Thereby when said secondary leg members are pivoted to an open position said fabric-like material forms a seat.

2. Description of the Prior Art

There are other backpack devices designed for carrying. Typical of these is U.S. Pat. No. 5,303,975 issued to Asato on Apr. 19, 1994.

Another patent was issued to Lamb et al. on Apr. 25, 1995 as U.S. Pat. No. 5,409,291. Yet another U.S. Pat. No. 5,492,255 was issued to Gansky et al. on Feb. 20, 1996 and still yet another was issued on Dec. 31, 1996 to Zirbel as U.S. Pat. No. 5,588,570.

Another patent was issued to Coca on Jun. 1, 1999 as U.S. Pat. No. Des. 410,333.

U.S. Pat. No. 5,303,975

Inventor: Simon Asato

Issued: Apr. 19, 1994

A chair conversion device for a backpack of the type having an external h-bar frame configuration which includes a pair of generally straight tubular side members each of which are pivotally connected adjacent their middle portions to existing side frame members of a provided backpack frame. The tubular side members are swingable through an arcuate range of motion between a first generally upright, storage position to a second open, chair use position. While in the open, chair use position, the bottom end portions of each tubular member form chair rear leg members for the resulting backpack folding chair. A pair of side strap members connects the bottom portions of each chair rear leg member to a bottom portion of the backpack frame to form right and left triangular side supports. An additional transverse strap connects each chair rear leg portion to each other to provide lateral stiffness for the backpack folding chair. A fabric type seat member having side ends folded over and hemmed closed to form loops attached to and extends between the upper ends the tubular side members to form the seating surface. In an alternate embodiment the seat member is cut in a trapezoidal configuration and is attached to the upper ends of the tubular side members in a manner such that the long side of a trapezoid forms the leading edge of the seating surface to create a cradle having a greater drop. In another alternate embodiment for the chair conversion device, a single, generally U-shaped tubular frame member is substituted in place of the two tubular side members and transverse strap member arrangement such that a bottom transversely oriented portion of the U-shaped member forms part of the chair rear leg support when the U-shaped frame member is pivoted to the open chair use position.

U.S. Pat. No. 5,409,291

Inventor: Timothy A Lamb et al.

Issued: Apr. 25, 1995

A combined chair and backpack includes a conventional folding lawn chair type frame having an upper transverse frame member pivotally connected to an upper portion of a pack frame. In an open orientation of the chair, the pack frame and chair back frame form an A-frame configuration to enhance stability. A removable reversible head rest/top pack assembly includes tubular side frame members, which telescopically receive upper mounting rod portions of the pack frame. In an open condition, the head rest faces the chair, and in a closed condition the head rest is reversed such that the top pack is disposed in overlying relation with respect to the collapsed chair. A plurality of straps suspends a pair of insulated beverage and food storage bags from respective opposite arm rests. Internal stiffeners maintain the bags erect. In a closed configuration, quick release straps secure edge portions of the bags in adjacent relation. An umbrella is mounted on an upper portion of the pack frame for independent compound pivotal adjustment about two perpendicular axes and usable in both closed transportation and open operative configurations of the chair. The combined chair and backpack includes a variety of attached comfort enhancing and sporting related features such as an insulated beverage holder, fishing creel, and fishing rod holder, all readily and immediately useable upon folding of the chair to an open configuration.

U.S. Pat. No. 5,492,255

Inventor: Alton E. Gansky et al.

Issued: Feb. 20, 1996

A multi-functional pack frame assembly which can be assembled and disassembled while selectively functioning as 1) a backpack support assembly; 2) an adjustable chair assembly; 3) a gun rest assembly; and 4) a table assembly. The multi-functional pack frame assembly includes 1) a pack and ground support assembly; 2) a table and gun rest assembly connected to the pack and ground support assembly; 3) a back rest support assembly connectable to the pack and ground support assembly when functioning as a back pack support cushion or chair support member; 4) an adjustable elevation support assembly connectable to the pack and ground support thereto; and 5) a shoulder connector and support assembly connected to the pack and ground support assembly for attachment to shoulder portions of a camper/hunter member for convenience thereof. The pack and ground support assembly provides a seat cushion member for functioning as a chair support member or a backpack support cushion. The table and gun rest assembly is a combination gun rest assembly and table member usable in selected interconnected conditions. The adjustable elevation support assembly includes a main support rod member connected to a support foot member and selectively connected to the pack and ground support assembly to provide an adjustable height function for support by the support foot member on an irregular terrain support surface.

U.S. Pat. No. 5,588,570

Inventor: Kurt D. Zirbel

Issued: Dec. 31, 1996

A combination backpack and seat device is provided which includes a frame separable into two members. The first member generally supports the backpack of the present invention and also provides a back rest for a seated user. The second member stores easily within the pouch of the backpack and can be attached to form an L-shaped structure. Once the second member of the frame is connected to the first member, a cushion can be lowered to form a low profile seat, which can be used for sitting. The present invention allows for comfort and ease in assembly, as well as a lightweight unit, which can be easily transported.

U.S. Pat. No. Des. 410,333

Inventor: Jammie Coca

Issued: Jun. 1, 1999

This United States Patent discloses an ornamental design for a fishing rod and reel case, as illustrated in the drawings of the patent.

While these backpack devices may be suitable for the purposes for which they were designed, they would not be as suitable for the purposes of the present invention, as hereinafter described.

SUMMARY OF THE PRESENT INVENTION

The present invention discloses a multipurpose backpack having a seat member. The device discloses a pair of upright standing frame members having a cross member further having a larger and smaller storage member disposed thereon. A pair of backstraps are used to secure the backpack to a user. The frame members are hollow and house an inner, extendable member having a tapered end for being positioned in soil. Pins are used to lock the inner legs into position. A pair of rotatable secondary legs are provided which when rotated comprise a seat member upon which the user can sit.

A primary object of the present invention is to provide a backpack-like device having primary leg members and a storage compartment disposed therebetween.

Another object of the present invention is to provide a backpack-like device having primary leg members which are substantially hollow wherein said leg members can be used as fishing rod holders.

Yet another object of the present invention is to provide a backpack-like device having primary leg members being substantially hollow and having straps attached thereto wherein said backpack can be attached to a boat console by said straps and said leg members can be used as fishing rod holders.

Still yet another object of the present invention is to provide a backpack-like device having primary leg members which are substantially hollow having an extendable and retractable portion contained therein allowing height adjustment, as well as the capability of leveling said device on uneven ground and having a pin for fixing said extendable portion to the selected position and said primary leg members having a tapered spike-like end providing means for easily inserting said device into sandy soil, as well as providing anchoring means for said backpack-like device.

Yet another object of the present invention is to provide a backpack-like device having primary leg members which are substantially hollow having exterior pivotal secondary leg member being of substantially the same size as the primary leg members. The secondary leg members having a fabric-like material attached there-between and said fabric-like material being additionally attached to the frame cross member. Thereby, when said secondary leg members are pivoted to an open position said fabric-like material forms a seat.

Additional objects of the present invention will appear as the description proceeds.

The present invention overcomes the shortcomings of the prior art by providing a backpack-like device comprising a frame member and a storage member. The frame member is constructed of a pair of primary leg members connected by a cross member having the storage member disposed there-between. The storage member can be compartmentalized. Each compartment having means for access comprising zippers and/or buckled flaps. Each primary leg member has an adjustable strap attached thereto providing means for carrying said backpack-like device. Also providing means for fixedly attaching said device to a boat console. The primary leg members are hollow tubes providing means for using said leg members as fishing rod holders or converting said leg members, through the use of additional attachments, into a rack for holding such items as a quiver of arrows or rifle.

Each primary leg member has an extendable and retractable portion contained therein allowing height adjustment, as well as the capability of leveling said device on uneven ground and having a pin for fixing said extendable portion to the selected position and said primary leg members having a tapered spike-like end providing means for easily inserting said device into sandy soil, as well as providing anchoring means for said backpack-like device. Further, said primary leg members having an exterior pivotal secondary leg member being of substantially the same size as the primary leg members. The secondary leg members have a fabric-like material attached there-between and said fabric-like material being additionally attached to the frame cross member. Thereby, when said secondary leg members are pivoted to an open position said fabric-like material forms a seat.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

Figure 2:
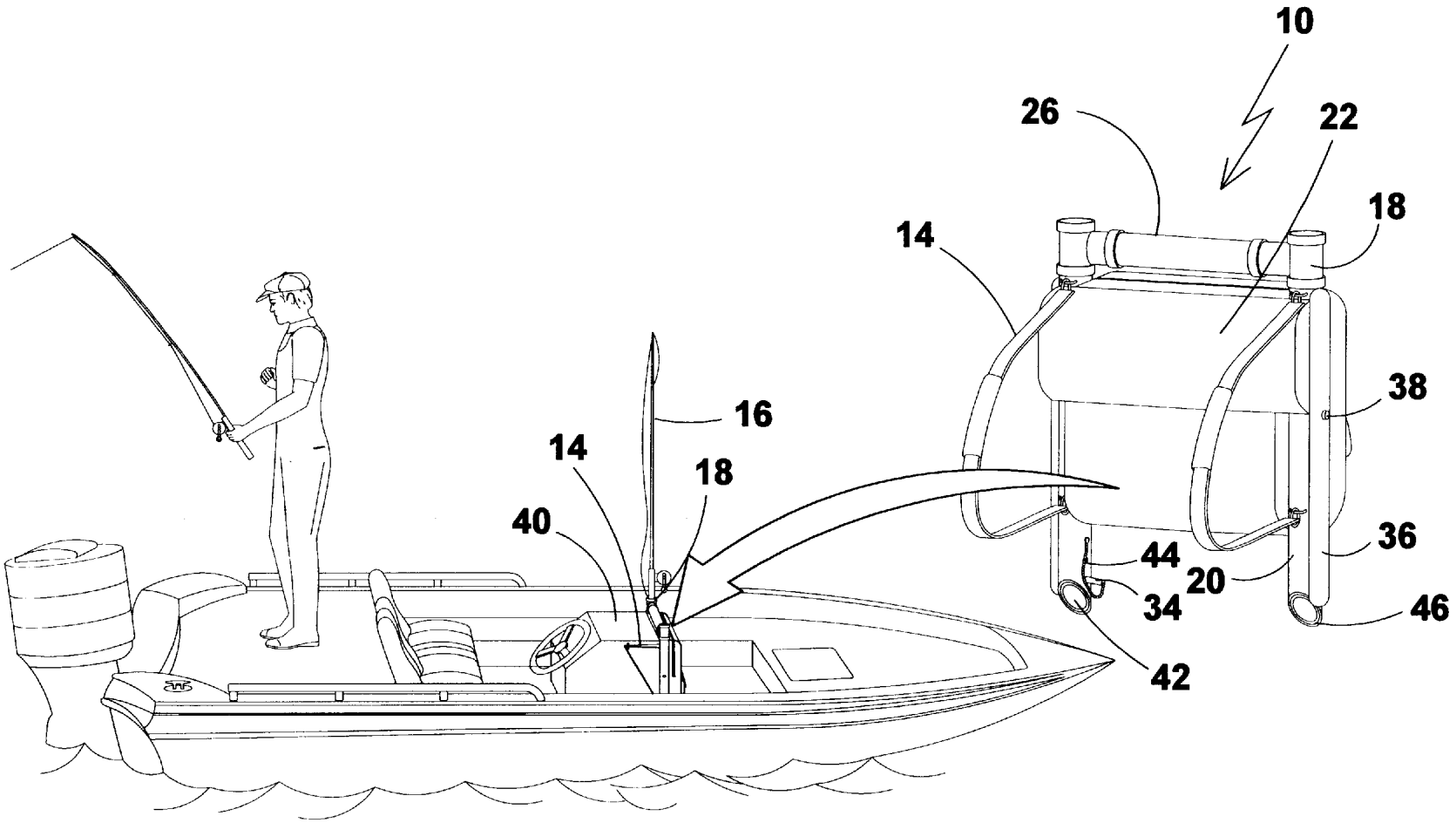

Each primary leg member has an extendable and retractable portion contained therein allowing height adjustment, as well as the capability of leveling said device on uneven ground and having a pin for fixing said extendable portion to the selected position and said primary leg members having a tapered spike-like end providing means for easily inserting said device into sandy soil, as well as providing anchoring means for said backpack-like device. Further, said primary leg members having an exterior pivotal secondary leg member being of substantially the same size as the primary leg members;

FIG. 2 is a perspective view of the present invention attached to a boat console by means of the straps having a fishing rod inserted into and extending from a primary leg member. Also shown is the backpack-like device comprising a frame member and a storage member. The frame member is constructed of a pair of primary leg members connected by a cross member having the storage member disposed there-between. The storage member is comprised of compartment having zippers and/or buckled flap providing access thereto. Each primary leg member has an adjustable strap attached thereto providing means for carrying said backpack-like device. Also providing means for fixedly attaching said device to a boat console. The primary leg members are hollow tubes providing means for using said leg members as fishing rod holders or converting said leg members, through the use of additional attachments, into a rack for holding such items as a quiver of arrows or rifle.

Figure 3:
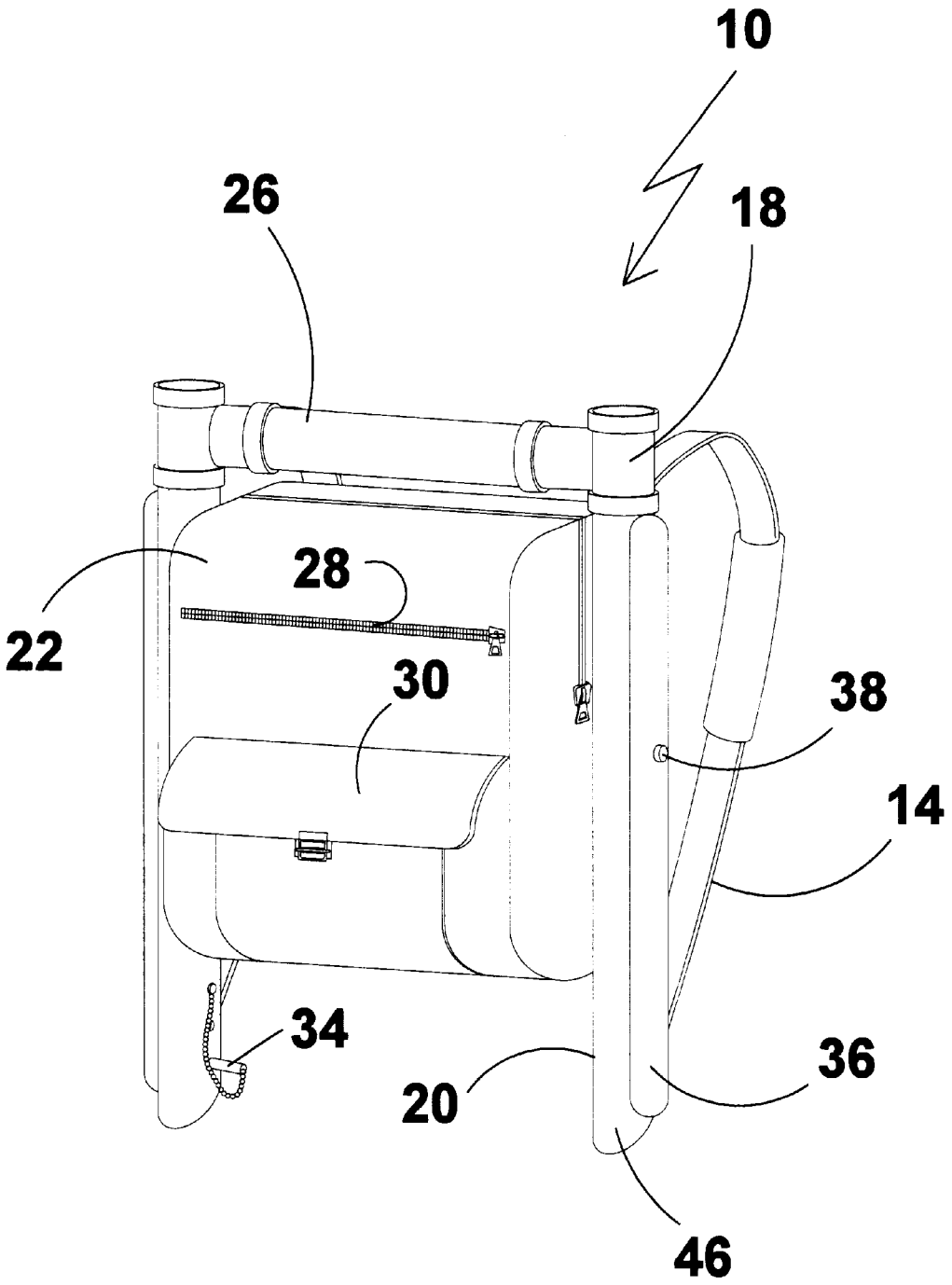

Each primary leg member has an extendable and retractable portion contained therein allowing height adjustment, as well as the capability of leveling said device on uneven ground and having a pin for fixing said extendable portion to the selected position and said primary leg members having a tapered spike-like end providing means for easily inserting said device into sandy soil, as well as providing anchoring means for said backpack-like device. Further, said primary leg members having an exterior pivotal secondary leg member being of substantially the same size as the primary leg members;

FIG. 3 is a front perspective view of the present invention, shown is the backpack-like device comprising a frame member and a storage member. The frame member is constructed of a pair of primary leg members connected by a cross member having the storage member disposed there-between. The storage member is comprised of compartment having zippers and/or buckled flap providing access thereto. Each primary leg member has an adjustable strap attached thereto providing means for carrying said backpack-like device. Also providing means for fixedly attaching said device to a boat console. The primary leg members are hollow tubes providing means for using said leg members as fishing rod holders or converting said leg members, through the use of additional attachments, into a rack for holding such items as a quiver of arrows or rifle.

Figure 4:
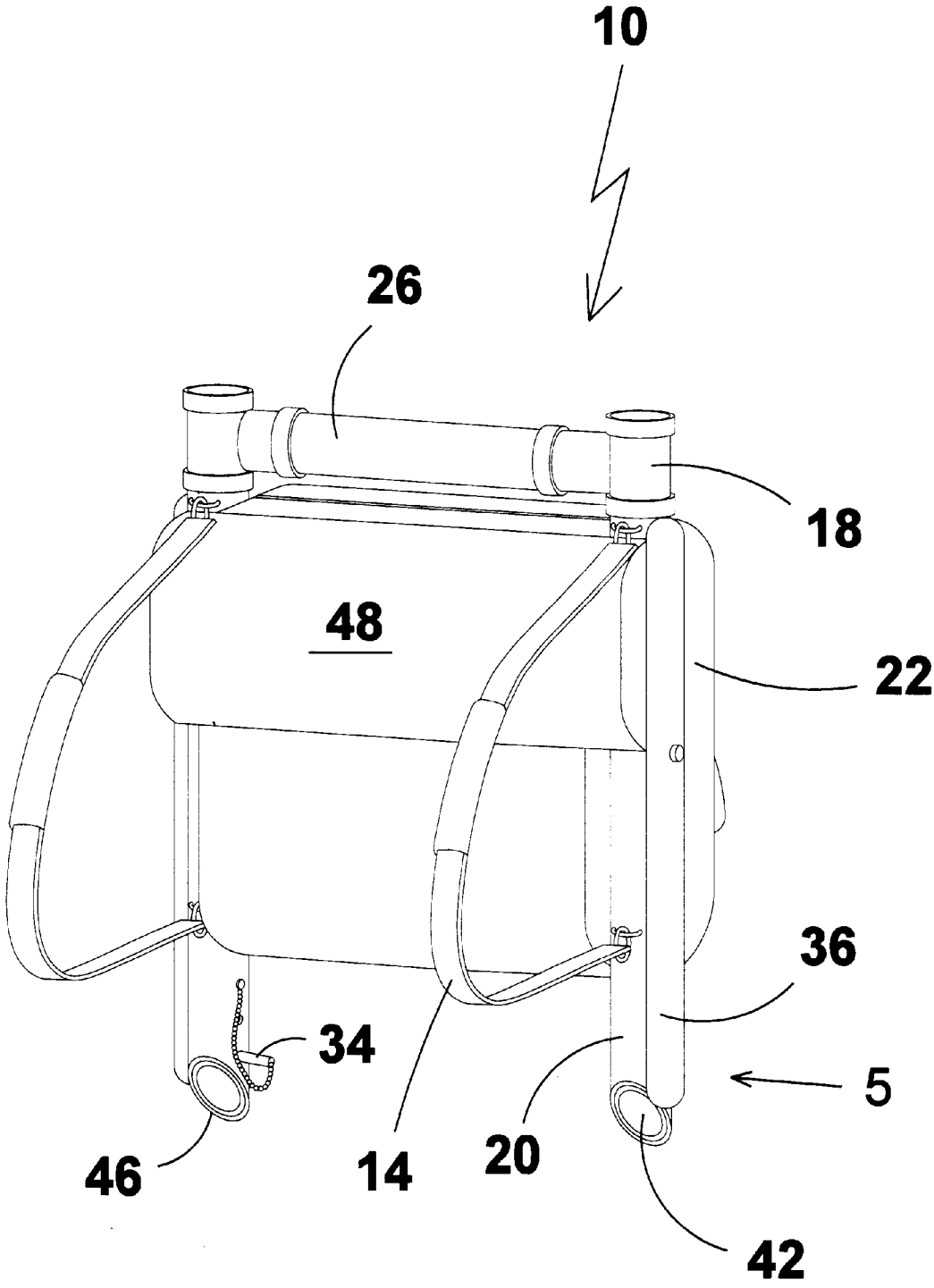

Each primary leg member has an extendable and retractable portion contained therein allowing height adjustment, as well as the capability of leveling said device on uneven ground and having a pin for fixing said extendable portion to the selected position and said primary leg members having a tapered spike-like end providing means for easily inserting said device in to sandy soil, as well as providing anchoring means for said backpack-like device. Further, said primary leg members having an exterior pivotal secondary leg member being of substantially the same size as the primary leg members;

FIG. 4 is a rear perspective view, taken from FIG. 3 as indicated, of the present invention, shown is a backpack-like device comprising a frame member and a storage member. The frame member is constructed of a pair of primary leg members connected by a cross member having the storage member disposed therebetween. Each primary leg member has an adjustable strap attached thereto providing means for carrying said backpack-like device. Also providing means for fixedly attaching said device to a boat console. The primary leg members are hollow tubes providing means for using said leg members as fishing rod holders or converting said leg members, through the use of additional attachments, into a rack for holding such items as a quiver of arrows or rifle.

Figure 5:
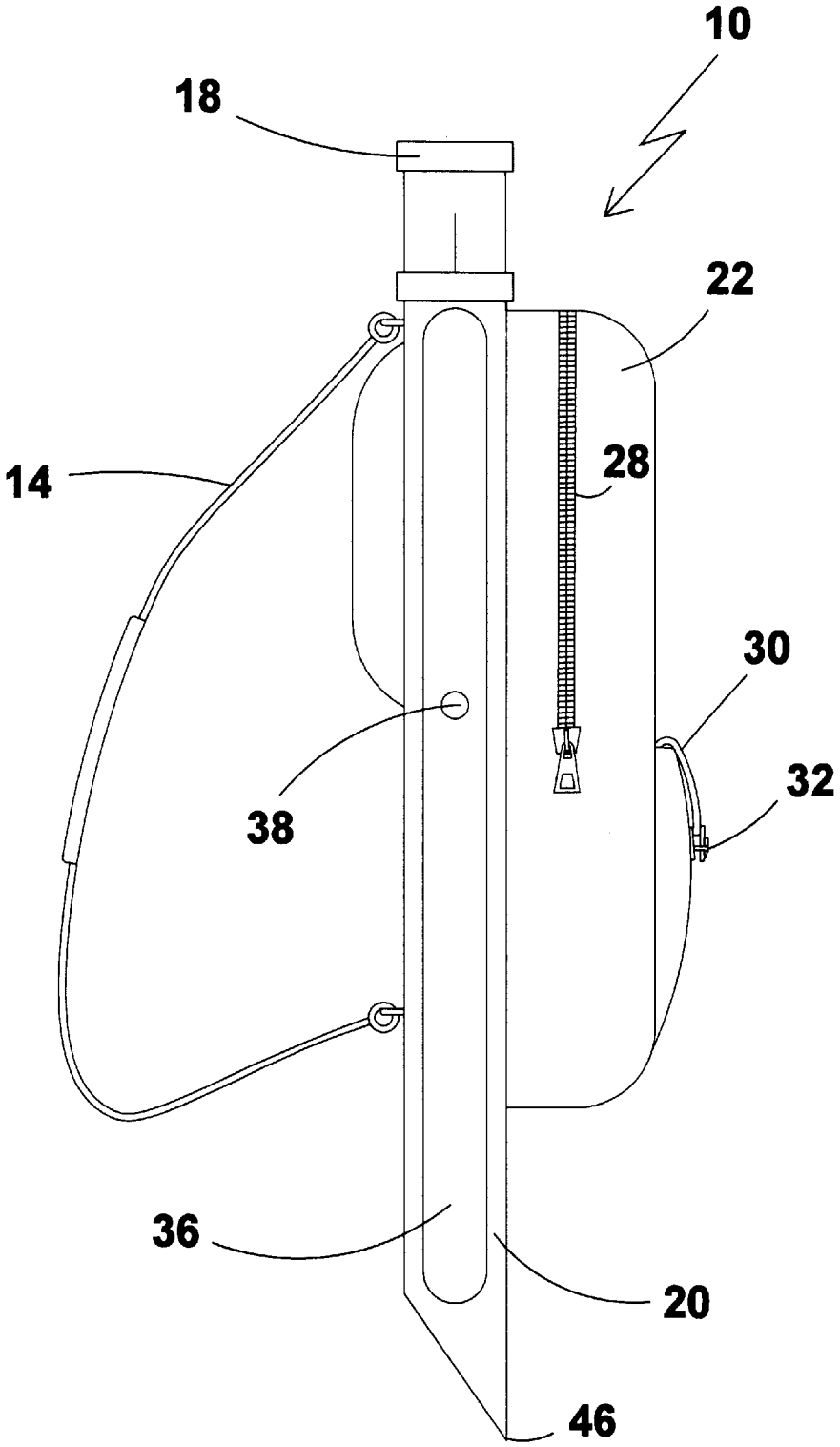

Each primary leg member has an extendable and retractable portion contained therein allowing height adjustment, as well as the capability of leveling said device on uneven ground and having a pin for fixing said extendable portion to the selected position and said primary leg members having a tapered spike-like end providing means for easily inserting said device into sandy soil, as well as providing anchoring means for said backpack-like device. Further said primary leg members having an exterior pivotal secondary leg member being of substantially the same size as the primary leg members. The secondary leg members have a fabric-like material attached therebetween and said fabric-like material being additionally attached to the frame cross member. Thereby, when said secondary leg members are pivoted to an open position said fabric-like material forms a seat;

FIG. 5 is a side view, taken from FIG. 4 as indicated, of the present invention, shown is a backpack-like device having a frame member and a storage member. The storage member has a plurality of compartments having zippers and/or buckled flaps providing means for access therein. Also shown is a primary leg member having an adjustable strap attached thereto providing means for carrying said backpack-like device. Also providing means for fixedly attaching said device to a boat console. The primary leg member is a hollow tube providing means for using said leg member as a fishing rod holder.

Figure 6:
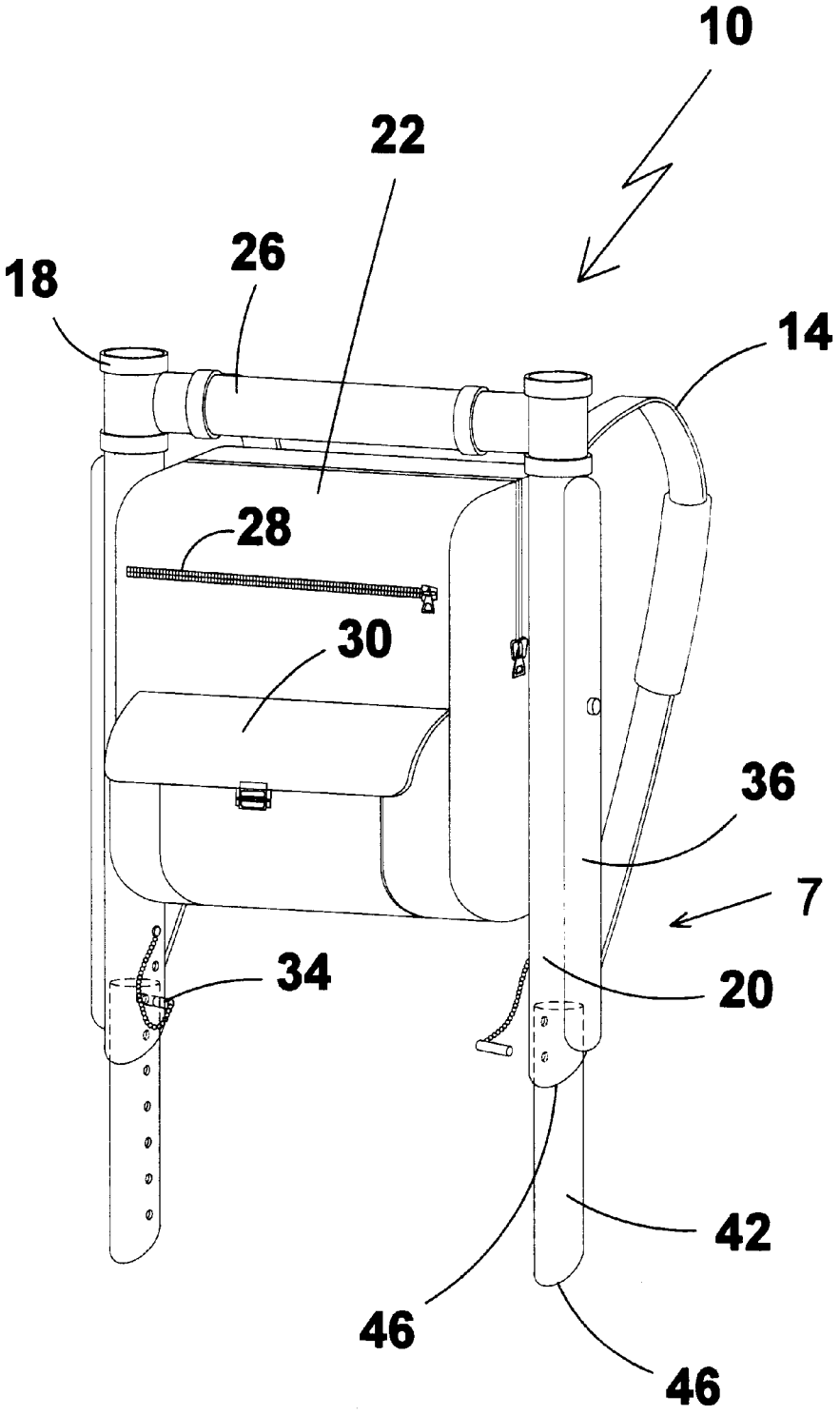

The leg member has an extendable and retractable portion contained therein allowing height adjustment, and having a pin for fixing said extendable portion to the selected position and said primary leg member having a tapered spike-like end providing means for easily inserting into sandy soil, as well as providing anchoring means for the backpack-like device. Further said primary leg member has an exterior pivotal secondary leg member being of substantially the same size as the primary leg members. The secondary leg member has a fabric-like material attached thereto;

FIG. 6 is a front perspective view of the present invention, taken from FIG. 3 as indicated, shown is a backpack-like device comprising a frame member and a storage member. The frame member is constructed of a pair of primary leg members connected by a cross member having the storage member disposed therebetween. The storage member has a plurality of compartments having zippers and/or buckled flaps providing means for access thereto. Each primary leg member has an adjustable strap attached providing means for carrying said backpack-like device. Also providing means for fixedly attaching said device to a boat console. The primary leg members are hollow tubes providing means for using said leg members as fishing rod holders or converting said leg members, through the use of additional attachments, into a rack for holding such items as a quiver of arrows or rifle.

Figure 7:
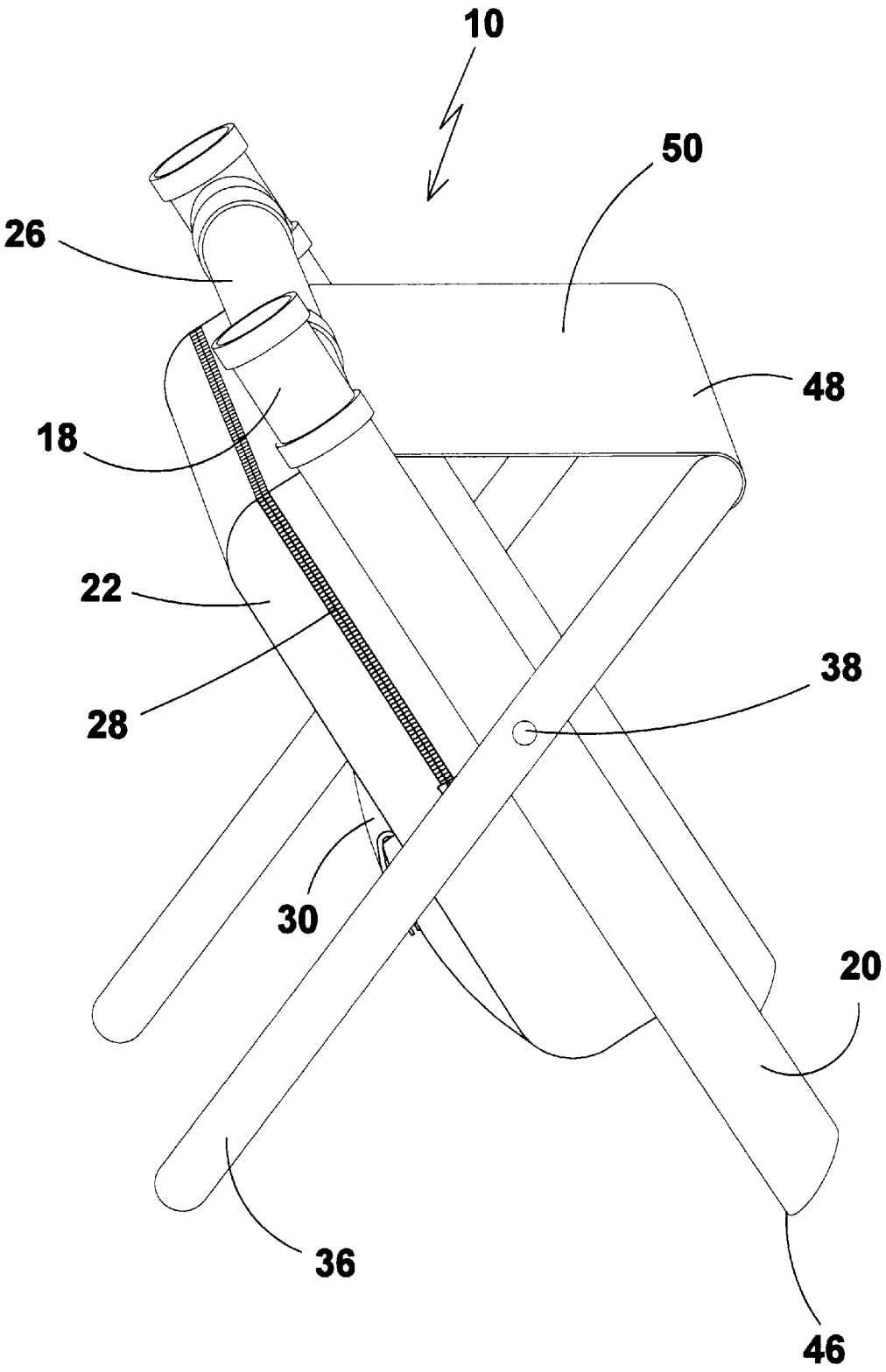

Each primary leg member has an extendable and retractable portion contained therein allowing height adjustment, as well as the capability of leveling said device on uneven ground and having a pin for fixing said extendable portion to the selected position and said primary leg members having a tapered spike-like end providing means for easily inserting said device into sandy soil, as well as providing anchoring means for said backpack-like device. Further said primary leg members having an exterior pivotal secondary leg member being of substantially the same size as the primary leg members. The secondary leg members have a fabric-like material attached there-between and said fabric-like material being additionally attached to the frame cross member. Thereby, when said secondary leg members are pivoted to an open position said fabric-like material forms a seat;

FIG. 7 is a perspective view of the present invention, taken from FIG. 6 as indicated, shown is the backpack-like device having the secondary leg members in a fully open position providing means for using said backpack-like device as a seat. Also shown is the backpack-like device comprising a frame member and a storage member. The frame member is constructed of a pair of primary leg members connected by a cross member having the storage member disposed there-between. The storage member has a plurality of compartment having zippers and/or buckled flap providing means for access thereto. Each primary leg member has an adjustable strap attached thereto providing means for carrying said backpack-like device. Also providing means for fixedly attaching said device to a boat console. The primary leg members are hollow tubes providing means for using said leg members as fishing rod holders or converting said leg members, through the use of additional attachments, into a rack for holding such items as a quiver of arrows or rifle.

Figure 8:
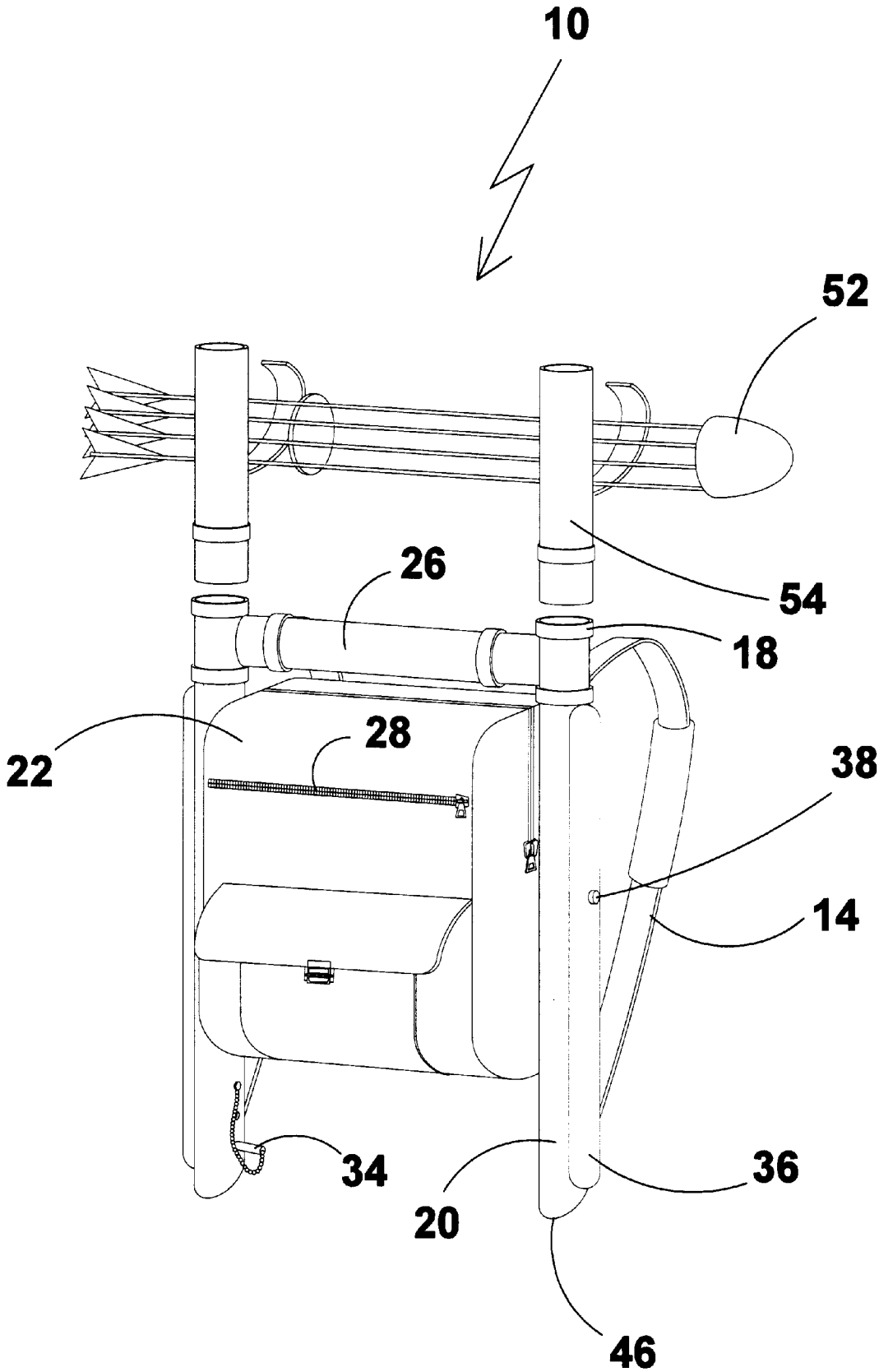

Each primary leg member has an extendable and retractable portion contained therein allowing height adjustment, as well as the capability of leveling said device on uneven ground and having a pin for fixing said extendable portion to the selected position and said primary leg members having a tapered spike-like end providing means for easily inserting said device into sandy soil, as well as providing anchoring means for said backpack-like device. Further said primary leg members having an exterior pivotal secondary leg member being of substantially the same size as the primary leg members. The secondary leg members have a fabric-like material attached there-between and said fabric-like material being additionally attached to the frame cross member. Thereby, when said secondary leg members are pivoted to an open position said fabric-like material forms a seat;

FIG. 8 is a perspective view of the present invention being used to carry a quiver of arrows. Also shown is the backpack-like device comprising a frame member and a storage member. The frame member is constructed of a pair of primary leg members connected by a cross member having the storage member disposed there-between. The storage member has a plurality of compartments having zippers and/or buckled flaps providing means for access thereto. Each primary leg member has an adjustable strap attached thereto providing means for carrying said backpack-like device. Also providing means for fixedly attaching said device to a boat console. The primary leg members are hollow tubes providing means for using said leg members as fishing rod holders or converting said leg members, through the use of additional attachments, into a rack for holding such items as a quiver of arrows or rifle.

Each primary leg member has an extendable and retractable portion contained therein allowing height adjustment, as well as the capability of leveling said device on uneven ground and having a pin for fixing said extendable portion to the selected position and said primary leg members having a tapered spike-like end providing means for easily inserting said device into sandy soil, as well as providing anchoring means for said backpack-like device. Further said primary leg members having an exterior pivotal secondary leg member being of substantially the same size as the primary leg members. The secondary leg members have a fabric-like material attached there-between and said fabric-like material being additionally attached to the frame cross member. Thereby, when said secondary leg members are pivoted to an open position said fabric-like material forms a seat.

LIST OF REFERENCE NUMERALS

With to reference numerals used, the following numbering is used throughout the drawings.

10 present invention
12 fisherman
14 shoulder straps
16 fishing rod
18 rod holder of primary leg member
20 primary frame or leg member
22 large storage member
24 small storage member
26 cross member
28 zipper
30 flap
32 buckle
34 pin
36 secondary leg member
38 pivot
40 console
42 extendable internal leg member
44 chain
46 tapered end
48 seat material
50 seat

52 arrows

54 attachment means

DESCRIPTION OF THE PREFERRED EMBODIMENT(S)

In order that the invention may be more fully understood, it will now be described, by way of example, with reference to the accompanying drawings in which FIGS. 1 through 8 illustrate the present invention being a multipurpose backpack which forms a seat.

Figure 1:
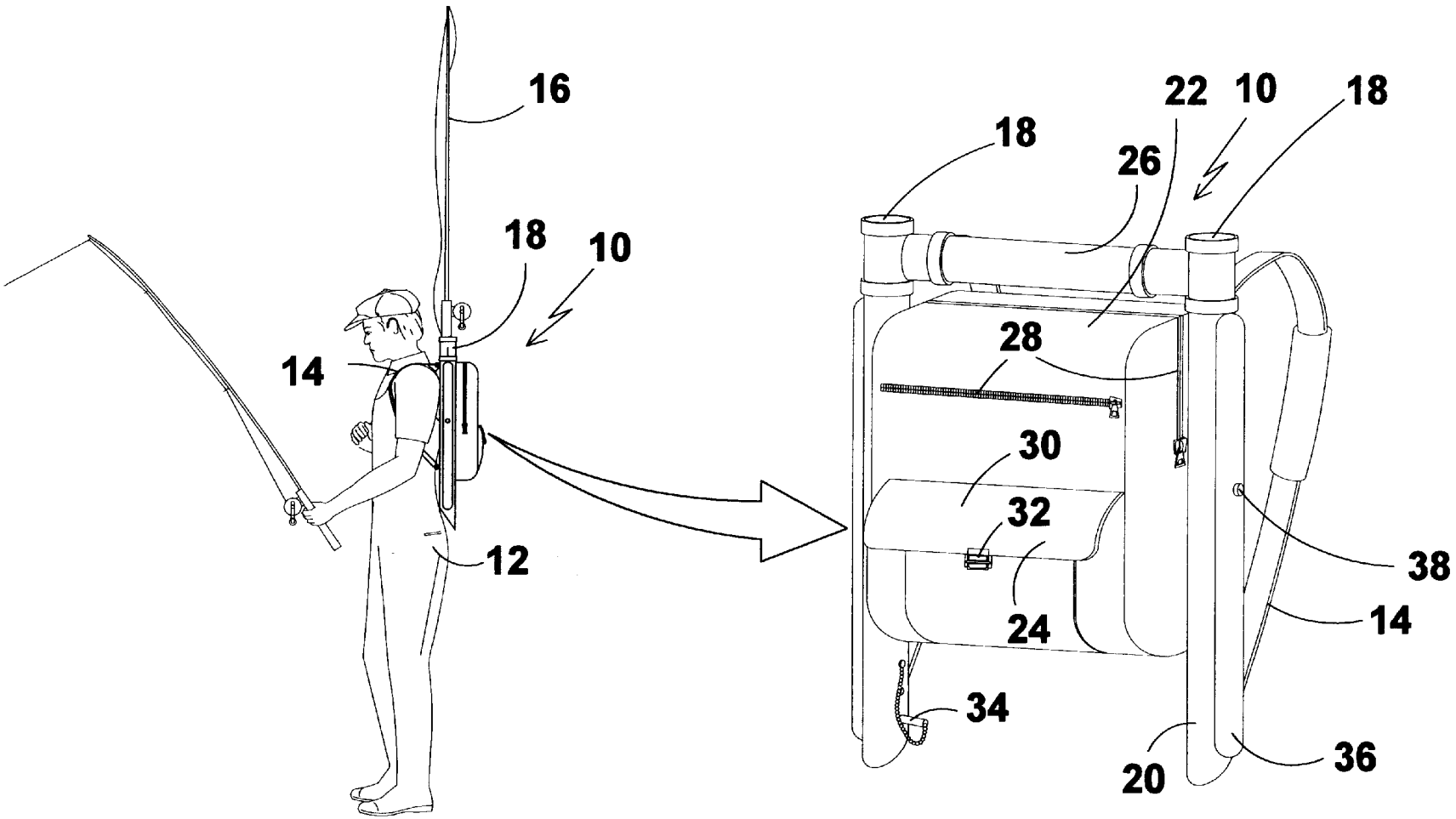
FIG. 1 is a perspective view of the present invention in use. Shown is a fisherman having the backpack-like device attached by means of the shoulder straps having a fishing rod being held within one of the primary leg members. Also shown is the backpack-like device comprising a frame member and a storage member. The frame member is constructed of a pair of primary leg members connected by a cross member having the storage member disposed there-between. The storage member is comprised of compartment having zippers and/or buckled flaps providing access thereto. Each primary leg member has an adjustable strap attached providing means for carrying said backpack-like device. The primary leg members are hollow tubes providing means for using said leg members as fishing rod holders.

Turning to FIG. 1, shown therein is a perspective view of the present invention 10 in use. Shown is a fisherman 12 having the backpack-like device 10 attached by means of the shoulder straps 14 having a fishing rod 16 being held within one of the primary leg members 18. Also shown is the backpack-like device 10 comprising a frame member 20 and large and small storage members 22, 24. The frame member 20 is constructed of a pair of primary leg members 20 connected by a cross member 26 having the storage members 22, 24 disposed there-between. The storage members 22, 24 are comprised of compartments having zippers 28 and/or buckled 32 flaps 30 providing access thereto. Each primary leg member 20 has an adjustable strap 14 attached providing means for carrying the backpack-like device 10. The primary leg members 20 are hollow tubes providing means for using the leg members 20 as fishing rod holders 18.

Each primary leg member 20 has an extendable and retractable portion contained therein allowing height adjustment, as well as the capability of leveling the device on uneven ground and having a pin 34 for fixing the extendable portion to the selected position and the primary leg members 20 having a tapered spike-like end providing means for easily inserting the device into sandy soil, as well as providing anchoring means for the backpack-like device. Further the primary leg members 20 having an exterior pivotal 38 secondary leg member 36 being of substantially the same size as the primary leg members 20.

Turning to FIG. 2, shown therein is a perspective view of the present invention 10 attached to a boat console 40 by means of the straps 14 having a fishing rod 16 inserted into and extending from a primary leg member 18. Also shown is the backpack-like device 10 comprising a frame member 20 and a storage member 22. The frame member 20 is constructed of a pair of primary leg members 20 connected by a cross member 26 having the storage member 22 disposed therebetween. The storage member 22 is comprised of compartments having zippers and/or buckled flaps providing access thereto. Each primary leg member 20 has an adjustable strap 14 attached thereto providing means for carrying the backpack-like device 10. Also the straps 14 provide means for fixedly attaching the device to a boat console 40. The primary leg members 20 are hollow tubes providing means for using the leg members 20 as fishing rod holders 18 or converting the leg members 20, through the use of additional attachments, into a rack for holding such items as a quiver of arrows or rifle.

Each primary leg member has an extendable and retractable portion 42 contained therein allowing height adjustment, as well as the capability of leveling said device on uneven ground and having a pin 34 attached with chain 44 for fixing the extendable portion to the selected position and the primary leg members 20 having a tapered spike-like end 46 providing means for easily inserting the device into sandy soil, as well as providing anchoring means for the backpack-like device 10. Further, the primary leg members 20 having an exterior pivotal secondary leg member 36 being of substantially the same size as the primary leg members 20.

Turning to FIG. 3, shown therein is a front perspective view of the present invention 10, shown is the backpack-like device 10 comprising a frame member 20 and a storage member 22. The frame member 20 is constructed of a pair of primary leg members 20 connected by a cross member 26 having the storage member 22 disposed there-between. The storage member 22 is comprised of compartments having zippers 28 and/or buckled flaps 30 providing access thereto. Each primary leg member 20 has an adjustable strap 14 attached thereto providing means for carrying the backpack-like device 10. The straps 14 provide means for fixedly attaching the device to a boat console. The primary leg members 20 are hollow tubes providing means for using the leg members 20 as fishing rod holders 18 or converting the leg members 20, through the use of additional attachments, into a rack for holding such items as a quiver of arrows or rifle.

Each primary leg member 20 has an extendable and retractable portion 42 (not shown) contained therein allowing height adjustment, as well as the capability of leveling the device on uneven ground and having a pin 34 for fixing the extendable portion to the selected position and the primary leg members 20 having a tapered spike-like end 46 providing means for easily inserting the device into sandy soil, as well as providing anchoring means for the backpack-like device 10. Further, the primary leg members 20 having an exterior pivotal 38 secondary leg member 36 being of substantially the same size as the primary leg members 20.

Turning to FIG. 4, shown therein is a rear perspective view, taken from FIG. 3 as indicated, of the present invention, showing a backpack-like device 10 comprising a frame member 20 and a storage member 22. The frame member 20 is constructed of a pair of primary leg members 22 connected by a cross member 26 having the storage member 22 disposed there-between. Each primary leg member 20 has an adjustable strap 14 attached thereto providing means for carrying the backpack-like device 10. The straps 14 also provide means for fixedly attaching the device to a boat console. The primary leg members 20 are hollow tubes providing means for using the leg members 20 as fishing rod holders 18 or converting the leg members 20, through the use of additional attachments, into a rack for holding such items as a quiver of arrows or rifle.

Each primary leg member 20 has an extendable and retractable portion 42 contained therein allowing height adjustment, as well as the capability of leveling the device on uneven ground and having a pin 34 for fixing the extendable portion 42 to the selected position and the primary leg members 20 having a tapered spike-like end 46 providing means for easily inserting the device into sandy soil, as well as providing anchoring means for the backpack-like device 10. Further, the primary leg members 20 having an exterior pivotal secondary leg member 36 being of substantially the same size as the primary leg members 20. The secondary leg members 36 have a fabric-like material 48 attached there-between and the fabric-like material 48 being additionally attached to the frame cross member 26. Thereby, when said secondary leg members 36 are pivoted to an open position the fabric-like material 48 forms a seat.

Turning to FIG. 5, shown therein is a side view, taken from FIG. 4 as indicated, of the present invention 10, showing a backpack-like device 10 having a frame member 20 and a storage member 22. The storage member 22 has a plurality of compartments having zippers 28 and/or buckled 32 flaps 30 providing means for access therein. Also shown is a primary leg member 20 having an adjustable strap 14 attached thereto providing means for carrying the backpack-like device. Straps 14 also provide means for fixedly attaching the device to a boat console. The primary leg member 20 is a hollow tube providing means for using said leg member as a fishing rod holder 18.

The leg member 20 has an extendable and retractable portion contained therein allowing height adjustment, and having a pin for fixing the extendable portion to the selected position and the primary leg member 20 having a tapered spike-like end 46 providing means for easily inserting into sandy soil, as well as providing anchoring means for the backpack-like device 10. Further, the primary leg member 20 has an exterior pivotal 38 secondary leg member 36 being of substantially the same size as the primary leg members. The secondary leg member 36 has a fabric-like material attached thereto.

Turning to FIG. 6, shown therein is a front perspective view of the present invention 10, taken from FIG. 3 as indicated, shown is a backpack-like device comprising a frame member 20 and a storage member 22. The frame member is constructed of a pair of primary leg members 20 connected by a cross member 26 having the storage member 22 disposed there-between. The storage member 22 has a plurality of compartments having zippers 38 and/or buckled flaps 30 providing means for access thereto. Each primary leg member 20 has an adjustable strap 14 attached providing means for carrying the backpack-like device 10. Straps 14 also provide means for fixedly attaching the device to a boat console. The primary leg members 20 are hollow tubes providing means for using the leg members 20 as fishing rod holders 18 or converting the leg members 20, through the use of additional attachments, into a rack for holding such items as a quiver of arrows or rifle.

Each primary leg member 20 has an extendable and retractable portion 42 contained therein allowing height adjustment, as well as the capability of leveling the device on uneven ground and having a pin 34 for fixing the extendable portion to the selected position and the primary leg members 20 having a tapered spike-like end 46 providing means for easily inserting the device into sandy soil, as well as providing anchoring means for the backpack-like device 10. Further, the primary leg members 20 having an exterior pivotal secondary leg member 36 being of substantially the same size as the primary leg members 20. The secondary leg members 36 have a fabric-like material attached therebetween and the fabric-like material being additionally attached to the frame cross member 26. Thereby, when the secondary leg members 36 are pivoted to an open position the fabric-like material forms a seat.

Turning to FIG. 7, shown therein is a perspective view of the present invention 10, taken from FIG. 6 as indicated, shown is the backpack-like device having the secondary leg members 36 in a fully open position providing means for using said backpack-like device as a seat 50. Also shown is the backpack-like device 10 comprising a frame member 20 and a storage member 22. The frame member 20 is constructed of a pair of primary leg members 20 connected by a cross member 26 having the storage member disposed therebetween. The storage member 22 has a plurality of compartments having zippers 28 and/or buckled flaps 30 providing means for access thereto. Each primary leg member 20 has an adjustable strap attached thereto providing means for carrying the backpack-like device. The straps 14 also provide means for fixedly attaching the device to a boat console. The primary leg members 20 are hollow tubes providing means for using the leg members 20 as fishing rod holders 18 or converting the leg members, through the use of additional attachments, into a rack for holding such items as a quiver of arrows or rifle.

Each primary leg member has an extendable and retractable portion contained therein allowing height adjustment, as well as the capability of leveling the device on uneven ground and having a pin for fixing the extendable portion to the selected position and the primary leg members 20 having a tapered spike-like end 46 providing means for easily inserting the device into sandy soil, as well as providing anchoring means for the backpack-like device. Further, the primary leg members 20 having an exterior pivotal secondary leg member 36 being of substantially the same size as the primary leg members 20. The secondary leg members 36 have a fabric-like material 48 attached there-between and the fabric-like material 48 being additionally attached to the frame cross member 26. Thereby, when the secondary leg members 36 are pivoted 38 to an open position the fabric-like material forms a seat 50.

Turning to FIG. 8, shown therein is a perspective view of the present invention 10 being used to carry a quiver of arrows 52. Also shown is the backpack-like device 10 comprising a frame member 20 and a storage member 22. The frame member is constructed of a pair of primary leg members 20 connected by a cross member 26 having the storage member 22 disposed there-between. The storage member 22 has a plurality of compartments having zippers 28 and/or buckled flaps 30 providing means for access thereto. Each primary leg member 20 has an adjustable strap 14 attached thereto providing means for carrying the backpack-like device 10. Straps 14 also provide means for fixedly attaching the device to a boat console. The primary leg members 20 are hollow tubes providing means for using the leg members 20 as fishing rod holders 18 or converting said leg members, through the use of additional attachment means 54, into a rack for holding such items as a quiver of arrows 52 or rifle.

Each primary leg member 20 has an extendable and retractable portion contained therein allowing height adjustment, as well as the capability of leveling the device 10 on uneven ground and having a pin 34 for fixing the extendable portion to the selected position and the primary leg members 20 having a tapered spike-like end 46 providing means for easily inserting the device into sandy soil, as well as providing anchoring means for the backpack-like device 10. Further, the primary leg members 20 having an exterior pivotal secondary leg member 36 being of substantially the same size as the primary leg members 20. The secondary leg members 36 have a fabric-like material attached there-between and the fabric-like material being additionally attached to the frame cross member 26. Thereby, when the secondary leg members 36 are pivoted by pivot means 38 to an open position the fabric-like material forms a seat.

What is claimed to be new and desired to be protected by Letters Patent is set forth in the appended claims:

1. An apparatus for a multipurpose backpack, comprising:

a) first and second generally upright spaced frame members being connected by a cross member, said cross member positioned near upper ends of said first and second frame members forming a right angled, inverted U-shaped configuration;

b) a storage compartment mounted between said first and second frame members and below said cross member;

c) said first and second frame members being hollow having an opening running there-through with openings into top and bottom ends of said frame members;

d) first and second extendable inner members disposed in lower ends of said first and second frame members, respectively;

e) a first strap having means for connection of its ends to said first frame-member for forming a first back-strap;

f) a second strap having means for connection of its ends to said second frame member for forming a second back-strap;

g) said frame members and said inner members having tapered bottom ends adapted for easy insertion into sandy soil, the tapered bottom ends of said frame and inner members being aligned with each other when said inner members are fully retracted into said frame members;

h) said first and second inner members being adjustably extendable out the bottom ends of said frame members and having means for being locked into a selected position comprising a pin member attached to each of said frame members, one end of each of said pin members connected by a chain to its respective frame member, and aligned apertures in said frame and inner members for receiving said pins to lock each said inner member in any selected retracted or extended position.

2. The apparatus of claim 1, said storage compartment further comprising multiple storage compartments.

3. The apparatus of claim 2, further comprising a first larger storage compartment and a second smaller storage compartment.

4. The apparatus of claim 3, said first larger storage compartment further comprising at least one zipper means for closing said first larger storage compartment.

5. The apparatus of claim 3, said second smaller storage compartment further comprising a flap having a means for closing said second smaller storage compartment.

6. The apparatus of claim 5, said closure means further comprising a buckle member.

7. The apparatus of claim 1, said first and second frame members having said openings at their top ends adapted to receive a fishing rod handle.

8. The apparatus of claim 7, further comprising a first auxiliary member positioned in said opening of said first frame member, and a second auxiliary member positioned in said opening of said second frame member, said first and second auxiliary members for receiving another item by attaching the item to said first and second auxiliary members.

9. The apparatus of claim 1, further comprising a first auxiliary leg member rotatably connected to the outside of said first frame member, further comprising a second auxiliary leg member rotatable connected to the outside of said second frame member.

10. The apparatus of claim 9, further comprising a fabric seat member having a first means for connecting to said cross member and a second means for connecting to the upper end of each of said first and second auxiliary leg members whereby said fabric seat member is extended when said first and second auxiliary leg members are partially rotated.

* * * * *